US011322274B2

(12) United States Patent
Gundel

(10) Patent No.: US 11,322,274 B2
(45) Date of Patent: May 3, 2022

(54) LOW DIELECTRIC CONSTANT STRUCTURES FOR CABLES

(71) Applicant: 3M INNOVATIVE PROPERTIES COMPANY, St. Paul, MN (US)

(72) Inventor: Douglas B. Gundel, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 17/259,053

(22) PCT Filed: Jul. 9, 2019

(86) PCT No.: PCT/IB2019/055836

§ 371 (c)(1),
(2) Date: Jan. 8, 2021

(87) PCT Pub. No.: WO2020/012354

PCT Pub. Date: Jan. 16, 2020

(65) Prior Publication Data

US 2021/0272719 A1 Sep. 2, 2021

Related U.S. Application Data

(60) Provisional application No. 62/696,501, filed on Jul. 11, 2018.

(51) Int. Cl.
*H01B 7/08* (2006.01)

(52) U.S. Cl.
CPC ..... *H01B 7/0861* (2013.01); *H01B 7/0846* (2013.01)

(58) Field of Classification Search
CPC ..... H01B 7/08; H01B 7/0861; H01B 7/846; H01B 7/0838; H01B 7/0233; H01B 11/203; H01B 11/1856
(Continued)

(56) References Cited

U.S. PATENT DOCUMENTS 3,496,281 A * 2/1970 McMahon ..... H01B 9/0655 174/29
7,238,886 B2 * 7/2007 Wiekhorst ..... H01B 7/0233 174/117 AS
(Continued)

FOREIGN PATENT DOCUMENTS

CN 204667917 9/2015
CN 205158937 4/2016
(Continued)

OTHER PUBLICATIONS

International Search Report for PCT International Application No. PCT/IB2019/055836, dated Dec. 13, 2019, 4 pages.

*Primary Examiner* — William H. Mayo, III
(74) *Attorney, Agent, or Firm* — Jonathan L. Tolstedt

(57) ABSTRACT

A ribbon cable is described, including a plurality of conductors extending along a length of the cable, and a structured insulative tape comprising a plurality of spaced apart supports forming alternating first and second groups of supports disposed on a major surface of the structured insulative tape. Each first group of supports includes at least one taller first support, and each second group of supports includes at least one shorter second support. The insulative tape is helically wrapped around the plurality of conductors along the length of the cable such that each first group of supports is disposed between and maintains a minimum separation between two adjacent conductors, and each second group of supports is disposed around one or more conductors to maintain spacing between the conductors and an outer surface of the ribbon cable.

20 Claims, 9 Drawing Sheets

(58) Field of Classification Search
USPC ..... 174/110 R, 113 R, 113 C, 117 R, 117 F, 174/117 FF
See application file for complete search history.

(56) References Cited

U.S. PATENT DOCUMENTS

| | | | | |
|---|---|---|---|---|
| 7,256,351 | B2 * | 8/2007 | Dillon | H01B 7/29 174/113 R |
| 9,355,755 | B2 * | 5/2016 | Gundel | G02B 6/4416 |
| 2018/0005729 | A1 | 1/2018 | Gundel | |

FOREIGN PATENT DOCUMENTS

| | | |
|---|---|---|
| WO | WO 2012-138717 | 10/2012 |
| WO | WO 2012-138729 | 10/2012 |

* cited by examiner

LOW DIELECTRIC CONSTANT STRUCTURES FOR CABLES

BACKGROUND

Electrical cables for transmission of electrical signals are well known. One common type of electrical cable is a coaxial cable. Coaxial cables generally include an electrically conductive wire surrounded by an insulating material. The wire and insulator are surrounded by a shield, and the wire, insulator, and shield are surrounded by a jacket. Another common type of electrical cable is a shielded electrical cable that includes one or more insulated signal conductors surrounded by a shielding layer formed, for example, by a metal foil.

SUMMARY

In some aspects of the present description, a ribbon cable is provided, including a plurality of conductors extending along a length of the cable; and a structured insulative tape including a plurality of spaced apart supports forming alternating first and second groups of supports disposed on a major surface thereof. Each first group of supports includes at least one taller first support, and each second group of supports includes at least one shorter second support. The insulative tape is helically wrapped around the conductors along the length of the cable such that each first group of supports is disposed between and maintains a minimum separation between two adjacent conductors, and each of the two adjacent conductors makes contact with a side of the taller first support. Each second group of supports is disposed around one or more conductors, such that each of the conductors makes contact with a top of the at least one shorter support.

In some aspects of the present description, a conductor set is provided, including a plurality of conductors, a structured insulative tape including a plurality of spaced apart supports forming alternating first and second groups of supports disposed on a major surface thereof, and an electrically conductive shield substantially surrounding the plurality of conductors and the structured insulative tape. Each first group of supports includes at least one taller first support, and each second group of supports includes at least one shorter second support. The insulative tape is helically wrapped around the conductors along the length of the cable such that each first group of supports is disposed between and maintains a minimum separation between two adjacent conductors, and each of the two adjacent conductors makes contact with a side of the taller first support. Each second group of supports is disposed around one or more conductors, such that each of the conductors makes contact with a top of the at least one shorter support.

In some aspects of the present description, a shielded electrical cable is provided, including a plurality of spaced apart, substantially parallel conductor sets extending along a length of the cable and arranged along a width of the cable. Each conductor set includes two substantially parallel conductors extending along the length of the cable and arranged along the width of the cable, and a structured insulative tape helically wrapped around the conductors of each conductor set along the length of the cable. The structured insulative tape includes a plurality of spaced apart first and second supports disposed on an inner major surface thereof facing the two conductors. Each first support is taller than each second support, and each first and second support extend substantially from a first lateral edge of the structured insulative tape to an opposite second lateral edge of the structured insulative tape. The first supports are disposed between and maintain a minimum separation between the two conductors, such that the two conductors make contact with opposite sides of the first supports, the second supports disposed around the two conductors and maintaining a minimum separation between the two conductors and the inner major surface of the structured insulative tape, the two conductors making contact with tops of the second supports.

In some aspects of the present description, a ribbon cable is provided, including a plurality of spaced apart, substantially parallel uninsulated conductors extending along a length of the cable and arranged along a width of the cable, a structured insulative tape including a plurality of spaced apart supports of equal heights integrally formed on a major surface thereof, and a spacer disposed and maintaining a minimum separation between each pair of adjacent uninsulated conductors along the length of the cable. The insulative tape is helically wrapped around the plurality of the uninsulated conductors along the length of the cable such that, for each helical wrap, each uninsulated conductor makes contact with a top of at least one support. The spacer makes contact with both uninsulated conductors and is not integrally formed with the insulative tape or either one of the uninsulated conductors.

In some aspects of the present description, a ribbon cable is provided, including a plurality of spaced apart, substantially parallel uninsulated conductors extending along a length of the cable and arranged along a width of the cable, an insulative tape helically wrapped around the uninsulated conductors along the length of the cable, and a spacer disposed and maintaining a minimum separation between each pair of adjacent uninsulated conductors along the length of the cable. For each helical wrap, each uninsulated conductor makes contact with the insulative tape. The spacer makes contact with both uninsulated conductors and is not integrally formed with the insulative tape or either one of the uninsulated conductors.

DETAILED DESCRIPTION

Figure 1A:
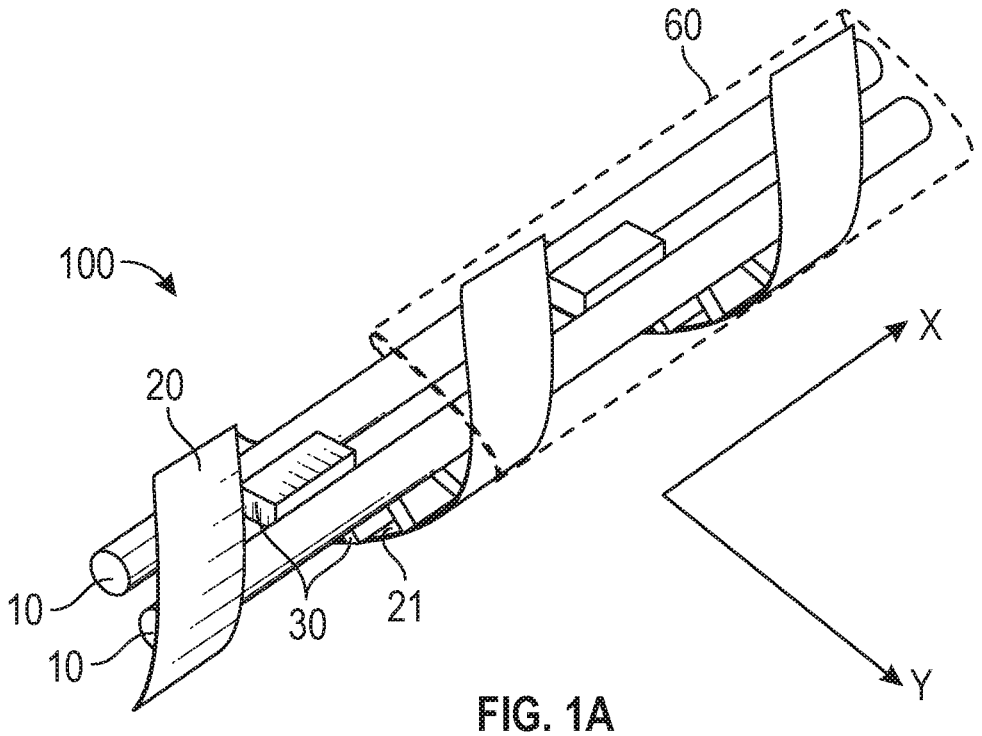
FIG. 1A is a perspective view of an electrical cable in accordance with an embodiment of the invention.

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

According to some aspects of the present description, electrical cables incorporating the structures described herein have been found to provide improved performance over conventional cables. For example, the electrical cables may have one or more of a reduced impedance variation along the cable length, lower skew, lower propagation delay, lower insertion loss, increased crush resistance, reduced cable size, increased conductor density, and improved bend performance compared to conventional cables.

In some embodiments, an electrical cable is constructed by creating a planar three-dimensional (3D) structured dielectric and then wrapping the structured dielectric helically around two or more signal conductors. The structured dielectric may be an insulative tape featuring a series of supports of varying heights. When the structured dielectric is wrapped around two or more conductors, the supports may provide precise spacing between adjacent conductors, as well as precise spacing between the conductors and a shielding film placed around the conductors, incorporating air into the cable as well as providing crush resistance. The supports may have a low effective dielectric constant and/or a low dielectric loss (e.g., low effective loss tangent). For example, the supports may have a high air (or other low dielectric constant material) content to provide the low effective dielectric constant. The supports may be a porous material with air in the voids. In some embodiments, the air content of the supports may be greater than 40%.

In some embodiments, each of the supports may have a dielectric constant of less than about 2, or less than about 1.7, or less than about 1.6, or less than about 1.5, or less than about 1.4, or less than about 1.3, or less than about 1.2. In some embodiments, an dielectric constant of the cable for at least one pair of adjacent conductors driven with differential signals of equal amplitude and opposite polarities is less than about 2.5, or less than about 2.2, or less than about 2, or less than 1.7, or less than about 1.6, or less than about 1.5, or less than about 1.4, or less than about 1.3, or less than about 1.2. The dielectric constant of the supports may be in any of the specified ranges when determined at an operating frequency of the cable and/or when determined at a frequency of 100 MHz, 1 GHz, or 10 GHz, for example.

The conductors may include any suitable conductive material, such as an elemental metal or a metal alloy (e.g., copper or a copper alloy), and may have a variety of cross sectional shapes and sizes. For example, in cross section, the conductors may be circular, oval, rectangular or any other shape. One or more conductors in a cable may have one shape and/or size that differs from other one or more conductors in the cable. The conductors may be solid or stranded wires. All the conductors in a cable may be stranded, all may be solid, or some may be stranded and some solid. Stranded conductors and/or ground wires may take on different sizes and/or shapes. The conductors may be coated or plated with various metals and/or metallic materials, including gold, silver, tin, and/or other materials.

In some embodiments, the supports may be adhered to the insulative tape of the structured dielectric. The supports may be placed such that, when the structured dielectric is helically wrapped around two or more conductors, a first subset of the supports is disposed between and maintains a minimum separation between adjacent conductors, and a second subset of the supports is disposed between each conductor and a surrounding shielding film. In some embodiments, the first subset of supports may be taller than the second subset of supports.

In some embodiments, one or more separate spacers may be used to separate adjacent conductors in addition to the supports of the structured dielectric. The spacers may be separately formed from the structured dielectric, and may be held in place by the conductors. In some embodiments, the spacers may be placed between adjacent conductors and then adhered to a structured dielectric which is helically wrapped around the conductors in the process of forming the electrical cable. In some embodiments, a spacer may be used in place of supports to separate adjacent conductors. The spacers may be made of a material which has a low effective dielectric constant and/or a low dielectric loss. For example, the spacers may have a high air content to provide the low effective dielectric constant.

In some embodiments, the cable can be produced with high uniformity to maintain a constant impedance, and related data transmission performance along a single transmission path or among cables of the same design manufactured at different times. In some embodiments, the spacing between conductors (e.g., center-to-center spacing) in the cable can be different (e.g., smaller) than the spacing in a direction orthogonal to the plane of the conductors between the shields included in the cables. This can allow for a high density of conductors in the cable, for example, which is highly desirable in some cases.

In some embodiments, the conductors of the cable are insulated with a dielectric layer. In some embodiments, incorporating low effective dielectric constant materials or structures in the insulative layer(s) of the cable allows the thickness of the dielectric layer to be smaller than that of conventional cables while providing a desired cable impedance (e.g., a differential impedance in a range of 70 ohms to 110 ohms). For example, conventional cables typically have a ratio of a diameter of the insulated conductor to the diameter of the conductor of the insulated conductor substantially greater than 2 (e.g., about 2.8 or higher), while this ratio for cables of the present description having the same impedance can be less than about 2 in some embodiments.

In some embodiments, an electrically conductive shield may be wrapped or otherwise placed around the conductors and structured dielectric. The shield may include an electrically conductive shielding layer disposed on an electrically insulative substrate layer. In some embodiments, the shield may include a first shield disposed on a top side of the electrical cable and a second shield disposed on a bottom side of the electrical cable. The shield may include cover portions and pinched portions, such that the cover portions create a channel or pocket which substantially surround and contain the conductors and structured dielectric, and the pinched portions are portions where the first and second shields are pushed together or nearly together and which may not contain conductors and structured dielectric.

Figure 1B:
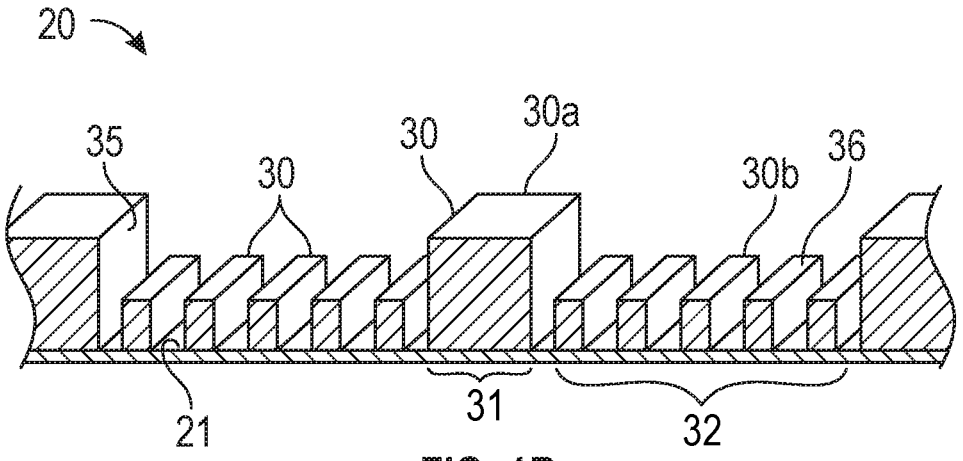
FIG. 1B is a perspective view of a structured insulative tape in accordance with an embodiment of the invention.
Figure 1C:
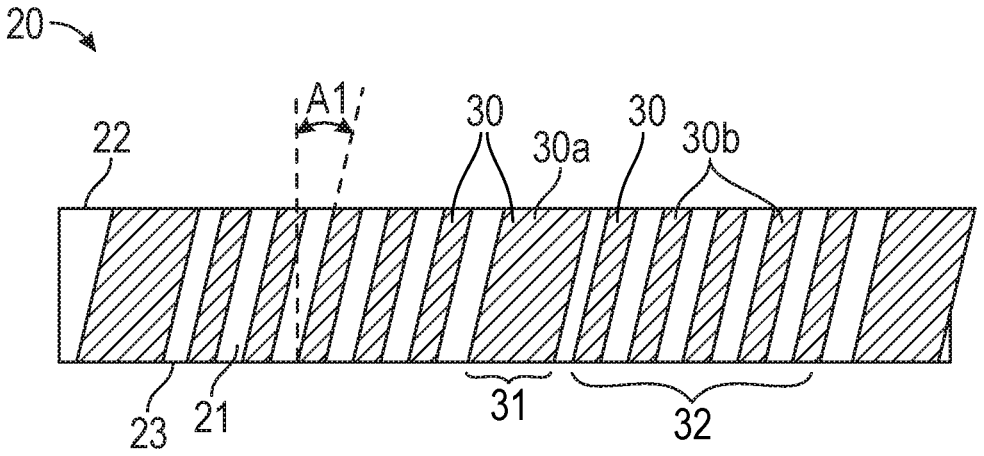
FIG. 1C is a top view of a structured insulative tape in accordance with an embodiment of the invention.

FIGS. 1A-1C illustrate an electrical cable with structured insulative tape in accordance with an embodiment of the invention. FIG. 1A is a perspective view of a ribbon cable 100 including a plurality of electrical conductors 10 extending along a length of the cable (e.g., in the x-direction of FIG. 1A), and a structured insulative tape 20 wrapped helically around the plurality of conductors 10 along the length of ribbon cable 100. The structured insulative tape 20 comprises a plurality of supports 30 of variable heights and dimensions disposed on a major surface 21 of the structured insulative tape 20. In some embodiments, a conductive shield 60 is wrapped around or otherwise encloses the conductors 10 and structured insulative tape 20.

FIG. 1B is a perspective view of a portion of the structured insulative tape 20 of FIG. 1A before it has been wrapped around conductors 10. In some embodiments, the plurality of supports 30 forms alternating first groups of supports 31 and second groups of supports 32 disposed on a major surface 21 of the structured insulative tape 20. In some embodiments, each first group of supports 31 includes at least one taller first support 30*a*, and each second group of supports 32 includes at least one shorter second support 30*b*. In some embodiments, each first group of supports 31 includes a single taller first support 30*a*, and each second group of supports 32 includes at least two spaced apart shorter second supports 30*b*. In some embodiments, each first group of supports 31 includes a single taller first support 30*a*, and at least one other first group of supports 31 includes two taller first supports 30*a*. In some embodiments, at least one second group of supports 32 includes a single shorter second support 30*b*, and at least one second group of supports 32 includes at least two shorter second supports 30*b*. The embodiments described are exemplary only and are not limiting in any way. Each first group of supports 31 may contain any appropriate number of taller first supports 30*a*, including but not limited to 1, 2, 4, 6, or 10, and each second group of supports 32 may contain any appropriate number of shorter second supports 30*b*, including but not limited to 1, 2, 4, 6, or 10.

When the structured insulative tape 20 is wrapped helically around conductors 10, as illustrated in FIG. 1A, each taller first support 30*a* extends up between and maintains a precise separation between adjacent conductors 10, such that each of the two adjacent conductors 10 make contact with a side 35 of the taller first support 30*a*. When the structured insulative tape 20 is wrapped helically around conductors 10, each shorter second support 30*b* is positioned such that it provides support for the conductors 10 and maintains a precise separation between conductors 10 and the major surface 21 of structured insulative tape 20 and/or conductive shield 60, such that each of the conductors 10 makes contact with a top side 36 of a shorter second support 30*b*.

FIG. 1C is a top view of a portion of the structured insulative tape 20 of FIG. 1B. The structured insulative tape 20 includes a plurality of supports 30 disposed on a major surface 21 of the structured insulative tape 20. The major surface 21 may be the top film of a backing layer constructed of a polyester, a Mylar, or any appropriate backing material. In some embodiments, supports 30 extend from a first lateral edge 22 to a second lateral edge 23 of the major surface 21. In other embodiments, supports 30 may extend only part way across the width of the major surface 21. The placement of the supports 30 on the major surface 21 may be such that an angle, A1, of the supports 30 corresponds to a wrap angle of the structured insulative tape 20 when it is helically wrapped around conductors 10. In some embodiments, the major surface 21 may be formed by a separate process than that used to create the supports 30, and the supports 30 may be adhered to the major surface 21 by an adhesive. In other embodiments, major surface 21 and supports 30 may be created in a single process as a single, cohesive structure. In yet other embodiments, a first subset of supports 30 may be adhered to or otherwise integral to major surface 21, while a second subset of supports 30 may be separate components. For example, in an embodiment, shorter second supports 30*b* (FIG. 2) may be adhered to major surface 21, and taller first supports 30*a* may be standalone components placed between adjacent conductors 10 before the structured insulative tape 20 is wrapped around the conductors 10.

Figure 2A:
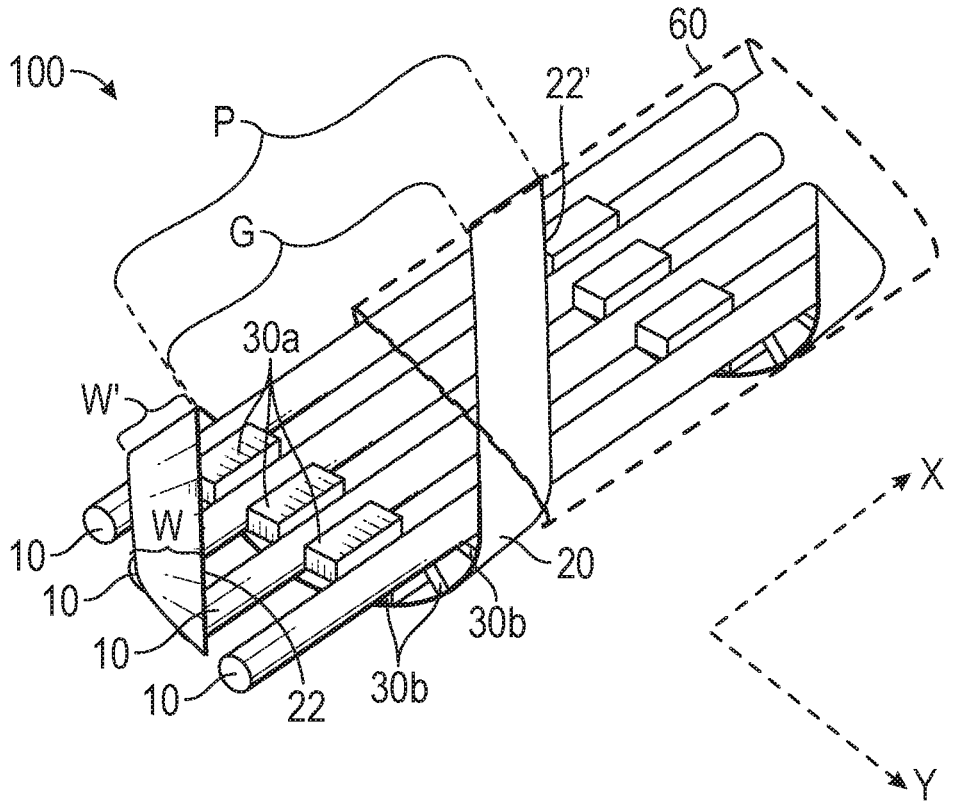
FIG. 2A is a perspective view of an electrical cable in accordance with an embodiment of the invention.
Figure 2B:
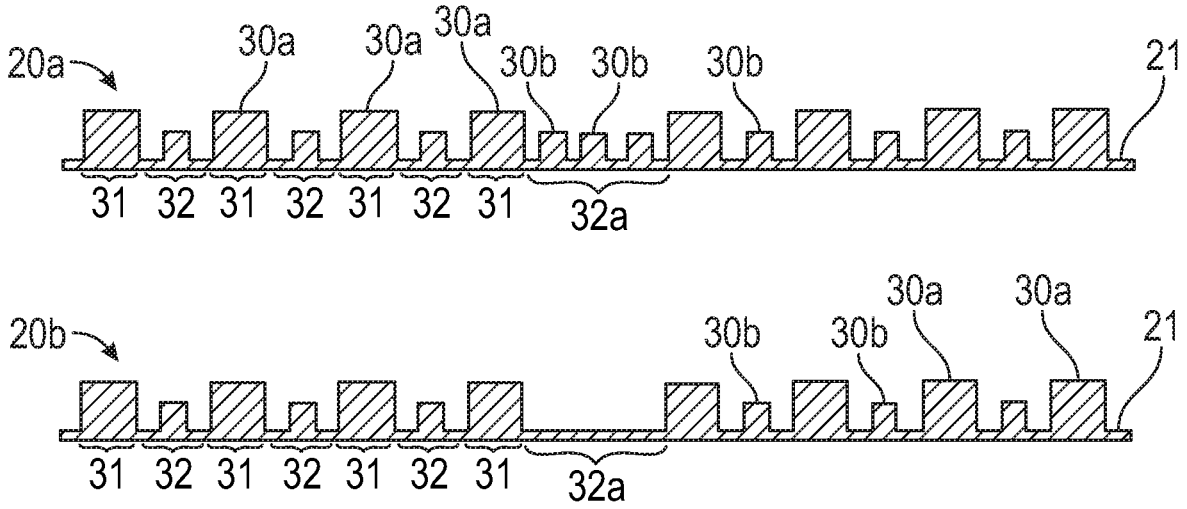
FIG. 2B is a side, profile view of a structured insulative tape in accordance with an embodiment of the invention.

FIGS. 2A-2B illustrate an electrical cable with structured insulative tape in accordance with an alternate embodiment of the invention. FIG. 2A is a perspective view of an embodiment of a ribbon cable 100 including a plurality of electrical conductors 10 extending along a length (e.g., in the x-direction of FIG. 2A) of the cable and a structured insulative tape 20 wrapped helically around the plurality of conductors 10 along the length of ribbon cable 100. The plurality of electrical conductors 10 are arranged along a width (e.g., in the y-direction of FIG. 2A) of the cable 100. Although the example of FIG. 2A includes four conductors (e.g., two inner signal wires and two outer ground/drain wires), any appropriate number of conductors may be used, including but not limited to 1, 2, 3, 4, 6, 8, 12, 25, or 50 conductors. The structured insulative tape 20 comprises a plurality of supports 30*a* and 30*b* disposed on a structured insulative tape 20. In some embodiments, a conductive shield 60 is wrapped around or otherwise encloses conductors 10 and structured insulative tape 20.

As described elsewhere, one or more taller first supports 30*a* extend up between and maintain a precise separation between adjacent conductors 10, and one or more shorter second supports 30*b* are positioned such that they provide support for conductors 10 and maintain a precise separation between conductors 10 and conductive shield 60. The structured insulative tape 20 has a defined width W and a projected width W' along the length of the cable and is wrapped around the conductors 10 at a pitch P, where P is defined as the distance from a lateral edge 22 of one wrap of the structured insulative tape 20 to the same lateral edge 22' of the immediately successive (adjacent) wrap of the structured insulative tape 20. The structured insulative tape 20 is helically wrapped around conductors 10 such that a difference between the projected width W' and pitch P defines a helical gap G between adjacent wraps of the structured insulative tape 20. In various embodiments, the width W and pitch P can be varied to create different helical gaps G. By increasing the helical gap G, it may be possible to increase the air content of ribbon cable 100 (i.e., create a lower effective dielectric constant and/or a lower dielectric loss). In an embodiment, the helical gap G may be greater than or equal to two times the width W of structured insulative tape 20. In some embodiments, the helical gap G may be greater than the projected width W' by at least a factor of 2. In another embodiment, helical gap G may be less than equal to zero (i.e., the pitch P may be adjusted such that successive adjacent wraps of structured insulative tape 20 touch or overlap each other, greatly reducing or eliminating helical gap G. Any appropriate width W, pitch P, and gap G may be used, depending on the desired electrical and physical properties of the ribbon cable 100.

In some embodiments, the heights of second supports 30*b* may be substantially equal throughout the length of structured insulative tape 20, such that a consistent spacing is maintained between conductors 10 and outer conductive shield 60. In other embodiments, the heights of second supports 30*b* may be varied over the length of structured insulative tape 20, such that the spacing between a first subset of the conductors 10 and the conductive shield 60 is different than the spacing between a second subset of the conductors 10 and the conductive shield 60. For example, in the four-conductor example of FIG. 2A, the two inner wires may be differential signal wires carrying data, and the two outer wires may be a ground/drain wires. It may be desirable in some embodiments to reduce or eliminate the spacing between the outer drain wires and the conductive shielding 60 to allow the drain wires to be more strongly electrically coupled.

FIG. 2B provides a side, profile view of two different structured insulative tapes 20*a* and 20*b* illustrating this concept. In both embodiments of the structured illustrative tape 20*a*/20*b*, as described elsewhere, the supports form alternating first groups of supports 31 and second groups of supports 32 disposed on a major surface 21 of the structured insulative tape 20. Each first group of supports 31 includes at least one taller first support 30*a*, and each second group of supports 32 includes at least one shorter second support 30*b*. In structured insulative tape 20*a* (top), each of supports 30*b* is substantially equal in height, providing consistent spacing between conductors and the conductive shield throughout when the structured insulative tape 20*a* is wrapped helically around the conductor sets. In the alternate embodiment of structured insulative tape 20*b* (bottom), the height of the second supports 30*b* in subgroup 32*a* is significantly reduced or entirely removed, such that any of the conductors which are located in 32*a* will be spaced closer to conductive shield 60 once the structured insulative tape 20*b* is helically wrapped around the conductor set. In this example, the area 32*a* of structured insulative tape 20*b* with the reduced or missing supports 30*b* may correspond to the outer conductors in the example of FIG. 2A.

Although the examples presented herein discuss varying the heights of or eliminating second supports 30*b*, the same principles may be applied to taller first supports 30*a*, as well. Various embodiments may use any number of sizes or shapes of supports 30 (including taller first supports 30*a* and shorter second supports 30*b*) to meet different ribbon cable design requirements. Supports 30 may be any appropriate shape, including, but not limited to, cylindrical, rectangular, pyramidal, spherical, hemispherical, and cross-shaped. Supports 30 may be solid forms or hollow to increase air content in the structures. In one embodiment, the heights of taller first supports 30*a* may be such that the tops of supports 30*a* extend up from the structured insulative tape 20 to a point past the conductors it is between. In another embodiment, the heights of taller first supports 30*a* may only extend up through a fraction of the diameter of the conductors, such as 10%, 25%, 50%, 75%, or 90% of the diameter of the conductors, or any other appropriate percentage of the diameter of the conductors. In an embodiment, the height of taller first supports 30*a* may be substantially equal to the height of shorter second supports 30*b*.

Figure 3A:
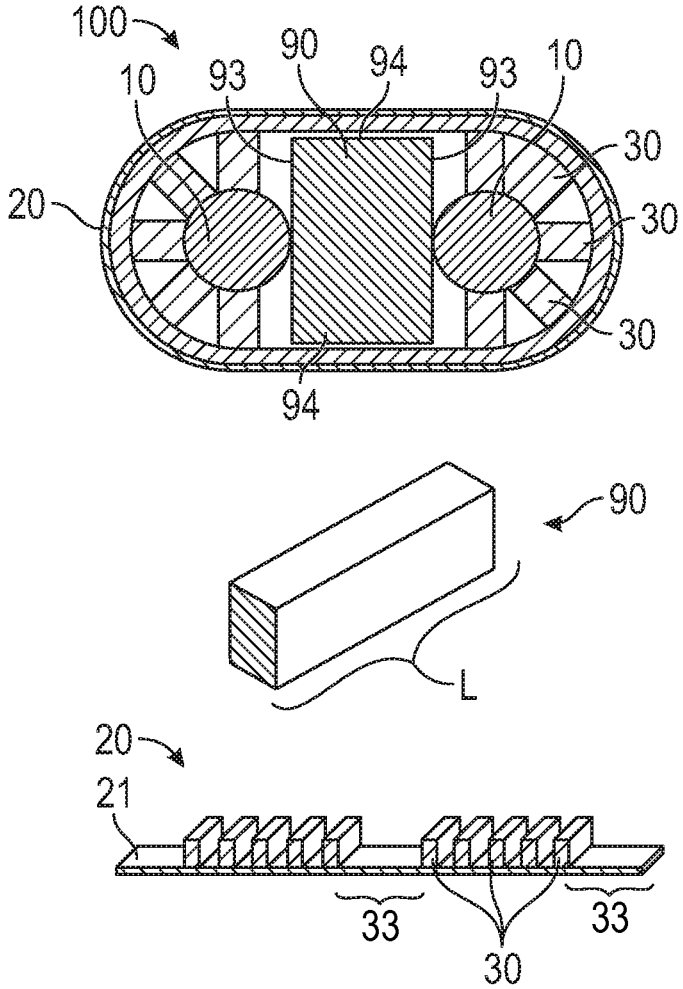
FIG. 3A-3B are cross-sectional views of an electrical cable in accordance with an embodiment of the invention.
Figure 3B:
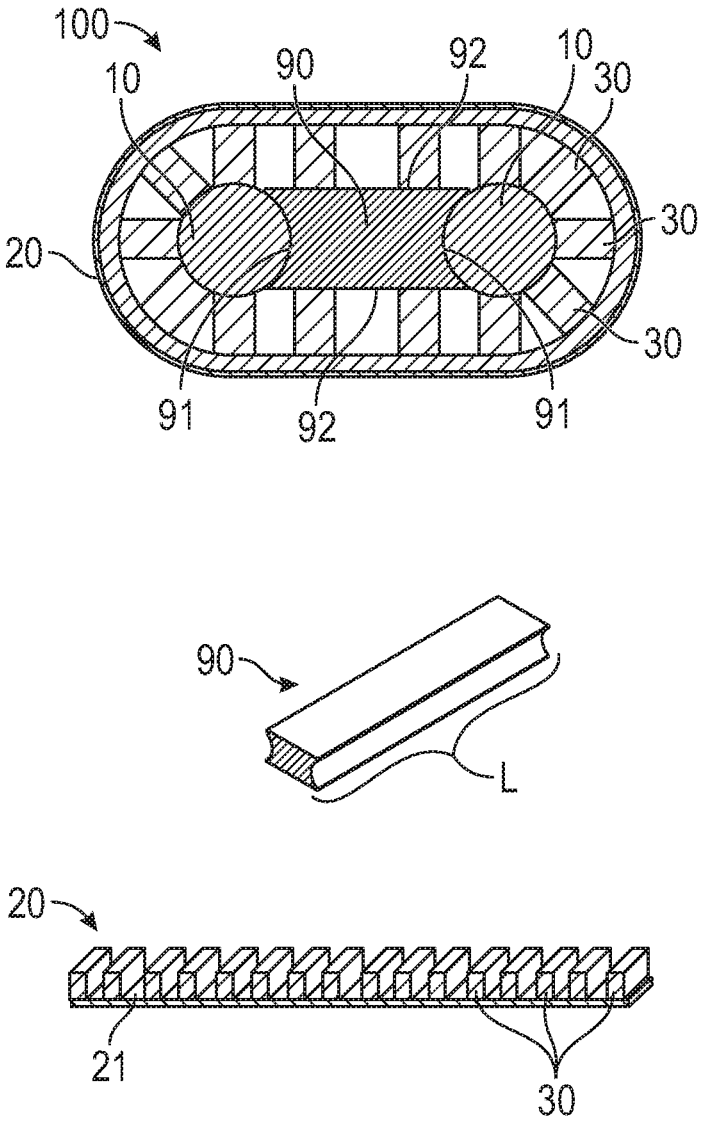

FIG. 3A-3B are cross-sectional views of an alternate embodiment of an electrical cable 100 in which a spacer 90 which is not integrally formed with the structured insulative tape 20 is used to separate and maintain spacing between adjacent conductors 10. As used herein, a first element "integrally formed" with a second element means that the first and second elements are manufactured together rather than manufactured separately and then subsequently joined. Integrally formed includes manufacturing a first element followed by manufacturing the second element on the first element. Integrally formed also includes manufacturing a first element with projected features in a single manufacturing step, such as, for example, molding a flat tape including a series of projected supports as a single, homogeneous component.

Turning to FIG. 3A, a ribbon cable 100 includes a plurality of spaced apart substantially parallel uninsulated conductors 10 extending along a length of the cable 100 and arranged along a width of the cable 100, and a structured insulative tape 20 comprising a plurality of spaced apart supports 30 of equal heights integrally formed on a major surface 21 thereof, the structured insulative tape 20 helically wrapped around the plurality of the uninsulated conductors 10 along the length of the cable 100 such that for each helical wrap, each uninsulated conductor 10 makes contact with a top of at least one support 30. The ribbon cable 100 further includes a spacer 90 disposed and maintaining a minimum separation between each pair of adjacent uninsulated conductors 10 along the length of the cable, the spacer 90 making contact with both uninsulated conductors 10 and not integrally formed with the structured insulative tape 20 or either one of the uninsulated conductors 10. The structured insulative tape 20 may be manufactured with an alternating pattern of groups of supports 30 and gaps 33. The spacer 90 may include opposing first sides 93, each first side 93 making contact with one of the uninsulated connectors 10, and opposing second sides 94, each second side 94 disposed within a gap 33 defined by two adjacent supports 30.

This spacer 90 is initially a separate component which may in some embodiments be held in place by the conductors and pressure from the surrounding structured insulative tape 20 without requiring additional adhesion to the conductors 10 or tape 20. In other embodiments, the spacer 90 may be placed in between conductors 10 and adhered to conductors 10, structured insulative tape 20, and/or supports 30 in a separate process. The spacers may be made of a material which has a low effective dielectric constant and/or a low dielectric loss. For example, the spacers may have a high air content to provide the low effective dielectric constant.

In the embodiment of FIG. 3B, the spacer 90 includes opposing first sides 91 shaped to conformingly make contact with insulated conductors 10, and opposing second sides 92 making contact with the structured insulative tape 20. In an embodiment, each first sides 91 may be a concave cylindrical arc and each second side 92 may be substantially flat. In the embodiment of FIG. 3B, spacer 90 is shaped and sized such that the overall height of ribbon cable 100 is defined by the height of spacer 90 and supports 30. That is, spacer 90 is held in place by conductors 10 on concave first sides 91 and supports 30 on substantially flat sides 92. In the embodiment shown, the structured insulative tape 20 would have a periodic arrangement of supports 30 covering substantially the entire length of structured insulative tape 20.

In some embodiments, the length L of spacer 90 of FIG. 3A or FIG. 3B may be substantially equal to the length of ribbon cable 100. That is, spacer 90 may be a continuous piece disposed between and separating conductors 10 for substantially the entire length of conductors 10 or ribbon cable 100, with no gaps. In other embodiments, spacer 90 may comprise a plurality of shorter, separate subsections, wherein the length L of each subsection is less than the length of ribbon cable 100, spaced apart from each other along the length of ribbon cable 100, such that the separate subsections alternate with pockets of air to create areas of lower dielectric constant along the length of ribbon cable 100.

Figure 4A:
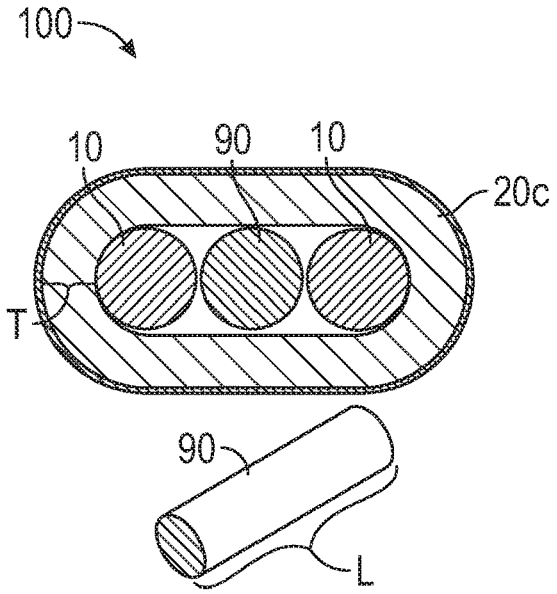
FIGS. 4A-4B are cross-sectional views of an electrical cable in accordance with an embodiment of the invention.
Figure 4B:
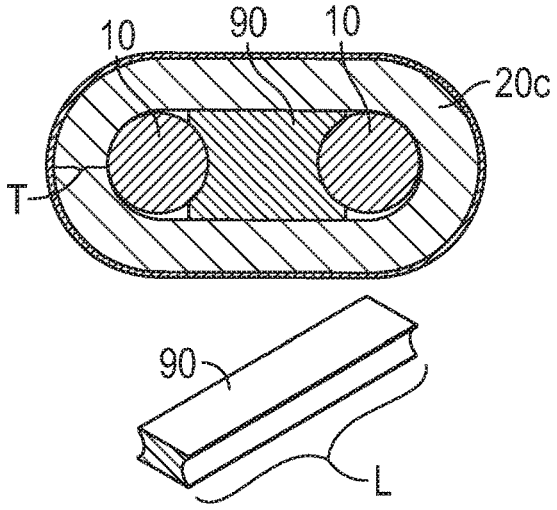
Figure 4C:
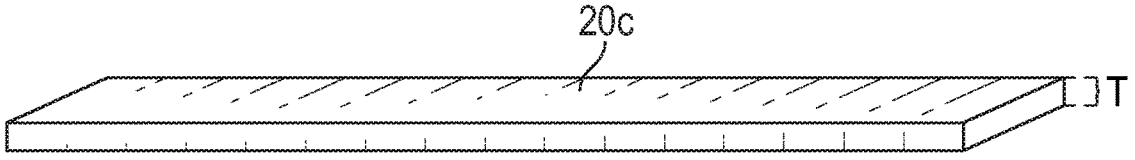
FIG. 4C is a perspective view of an insulative tape in accordance with an embodiment of the invention.

FIGS. 4A-4B are cross-sectional views of an alternate embodiment of an electrical cable 100 in which an insulative tape 20*a* and a separate spacer 90 provide the structure and support for a ribbon cable 100. FIG. 4C provides a perspective view of the insulative tape 20*c* of FIGS. 4A-4B, illustrating that insulative tape 20*c* does not have projected support structures (such as supports 30 of FIG. 1A). Instead of supports, insulative tape 20*c* may be a solid dielectric or a flat tape structure that contains air or a foamed material with a low dielectric constant. In an embodiment, insulative tape 20*c* may be wrapped helically around conductors 10 for the length of ribbon cable 100, and conductors 10 may be separated by one or more spacers 90. In the embodiments of FIGS. 4A and 4B, spacing between conductors 10 and an outer conductive shield (not shown) is provided by the thickness T of insulative tape 20*c*, rather than from supports (such as supports 30 of FIG. 1A).

In the embodiment of FIG. 4A, spacer 90 may be have a cylindrical shape, and may be placed between adjacent conductors 10 to provide and maintain a spacing between the conductors 10. In some embodiments, spacer 90 may be a continuous piece disposed between and separating conductors 10 for substantially the entire length of conductors 10 or ribbon cable 100, with no gaps. In other embodiments, spacer 90 may comprise a plurality of shorter, separate subsections, wherein the length L of each subsection is less than the length of ribbon cable 100, spaced apart from each other along the length of ribbon cable 100, such that the separate subsections alternate with pockets of air to create areas of lower dielectric constant along the length of ribbon cable 100. In other embodiments, spacer 90 may have alternate shapes, such as the shape illustrated in FIG. 4B. Although two example shapes for spacer 90 are illustrated in FIGS. 4A and 4B, these examples are not meant to be limiting. Any appropriate shape, size, and length of spacer 90 may be used to provide spacing between adjacent conductors 10.

In some embodiments, spacer 90 may be held in place by contact with conductors 10 and/or insulative tape 20*c*, which may be wrapped helically around conductors 10. In some embodiments, an outer conductive shield and/or a cable jacket (not shown) may surround and contain conductors 10, spacer 90, and insulative tape 20*c*. In other embodiments, an adhesive may be applied between spacer 90 and insulative tape 20*c* and/or conductors 10 to hold ribbon cable 100 together.

As illustrated in FIGS. 1A and 2A, some embodiments of ribbon cable 100 may have one or more electrically conductive shields 60 substantially surrounding conductors 10 and structured insulative tape 20 (e.g., the one or more electrically conductive shields 60 may surround at least 60% or at least 80% or a perimeter of the conductors 10 and insulative tape 20, or may completely surround the conductors 10 and insulative tape 20). The conductive shield 60 may be composed of braided strands of metal, a spiral winding of metallic tape, a conductive polymer film, or any other appropriate conductive shielding material. In some embodiments, the conductive shield 60 may be enclosed within a protective jacket (not shown), which provides protection for the ribbon cable 100 from items which may damage the cable, such as, for example, moisture, mechanical damage, fire, and chemical exposure. In some embodiments, the purpose of a conductive shield 60 is to reduce or eliminate electrical noise from external sources, and to reduce the electromagnetic radiation produced by the ribbon cable 100. In some embodiments, the conductive shield 60 may also act as a return path for a data signal propagating through conductors 10. In some embodiments, the conductive shield 60 may include an electrically conductive shielding layer disposed on an electrically insulative substrate layer.

Figure 5A:
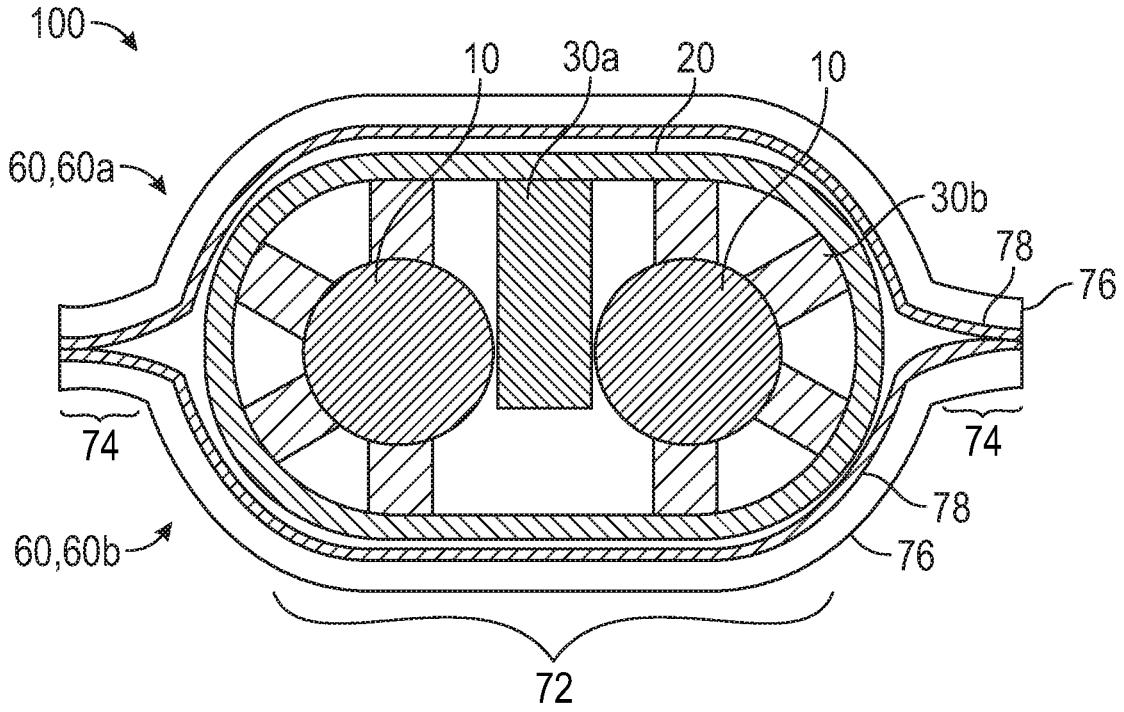
FIGS. 5A-5B are cross-sectional views of an electrical cable in accordance with an embodiment of the invention.

In some embodiments, the conductive shield 60 may be longitudinally wrapped around ribbon cable 100. In other embodiments, conductive shield 60 may be helically wrapped around ribbon cable 100. In still other embodiments, conductive shield 60 may include a first and second shield layer disposed respectively on top and bottom sides of ribbon cable 100. FIG. 5A illustrates a cross-sectional view of an electrical cable in accordance with an embodiment of the invention, wherein conductive shield 60 includes a first shield layer 60*a* and a second shield layer 60*b* disposed on opposing sides of ribbon cable 100. Each shield layer 60*a* and 60*b* may include an electrically conductive shielding layer 76 disposed on an electrically insulative substrate layer 78.

The conductive shielding layer 76 may include any suitable conductive material, including but not limited to copper, silver, aluminum, gold, and alloys thereof. The electrically insulative substrate layer 78 may be an electromagnetic interference (EMI) absorbing layer. For example, electrically insulative substrate layer 78 may include EMI absorbing filler material (e.g., ferrite materials). Alternatively, or in addition, in some embodiments, one or more separate EMI absorbing layers are included. The conductive shielding layer 76 and electrically insulative substrate layer 78 may have a thickness in the range of 0.01 mm to 0.05 mm and the overall thickness of the cable may be less than 2 mm or less than 1 mm.

Shield layers 60*a* and 60*b* are disposed on respective top and bottom sides of ribbon cable 100 such that they include cover portions 72 and pinched portions 74. Cover portions 72 of first shield layer 60*a* and second shield layer 60*b* are aligned or otherwise arranged with respect to each other such that, in combination, they surround ribbon cable 100. Similarly, pinched portions 74 of first shield layer 60*a* and second shield layer 60*b* are aligned or otherwise arranged to form pinched portions 74 in shield 60, substantially enclosing and isolating conductors 10 and structured insulative tape 20. In some embodiments, an adhesive may be used between the pinched portions 74 of first shield layer 60*a* and second shield layer 60*b*. One or more taller first supports 30*a* extend up from structured insulative tape 20, maintaining precise spacing between conductors 10, and one or more shorter second supports 30*b* provide and maintain spacing between conductors 10 and shield 60.

Figure 5B:
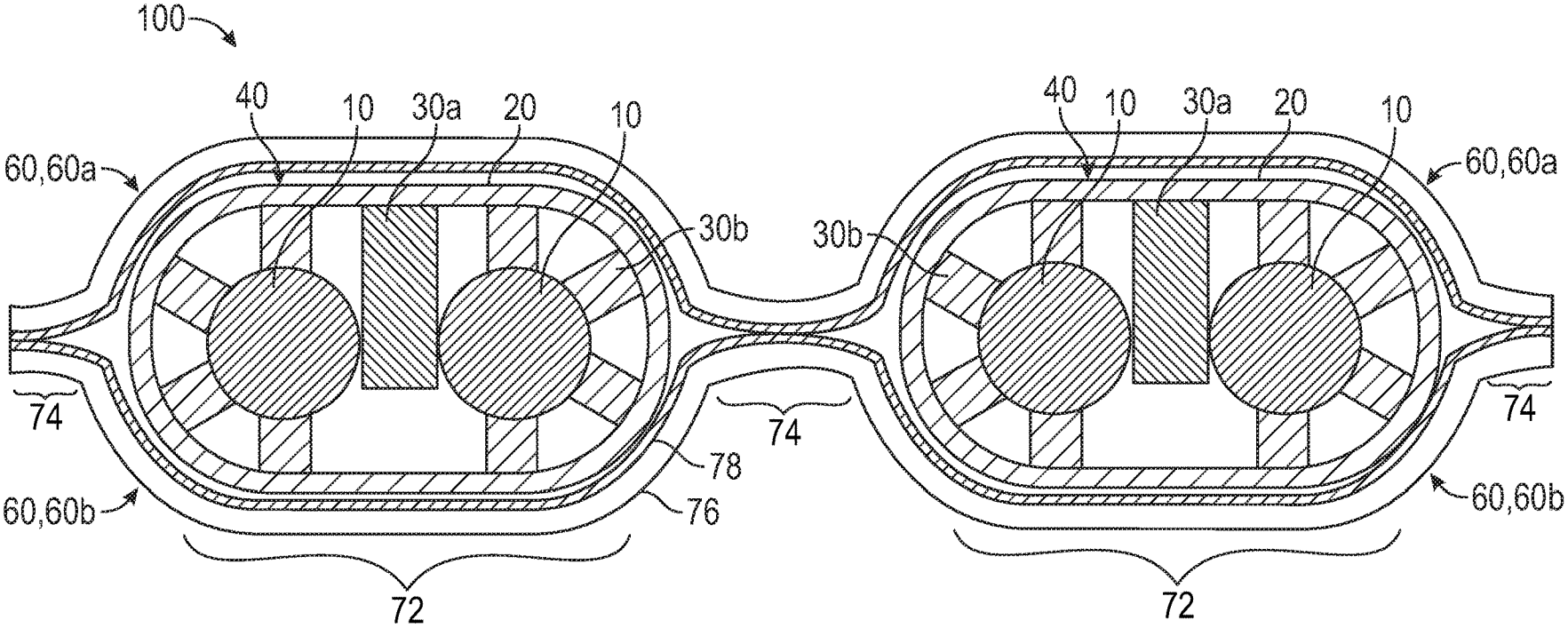

FIG. 5B illustrates a cross-sectional view of a shielded electrical cable in accordance with an embodiment of the invention. The shielded electrical cable 100 includes a plurality of spaced apart substantially parallel conductor sets 40 extending along the length of the cable 100 and arranged along the width of the cable 100. In some embodiments, each conductor set 40 includes two or more substantially parallel conductors 10 extending along the length of the cable 100 and arranged along the width of the cable 100. In some embodiments, at least one of the conductors 10 in at least one conductor set 40 is an uninsulated conductor. In some embodiments, at least one of the conductors 10 in at least one conductor set 40 is an insulated conductor. A structured insulative tape 20 is helically wrapped around the two or more conductors 10 of each conductor set 40 along the of the cable 100, the structured insulative tape 20 including a plurality of spaced apart first supports 30*a* and second supports 30*b* disposed on an inner major surface 21 facing the two or more conductors 10, each first support 30*a* taller than each second support 30*b*, each first support 30*a* and each second support 30*b* extending substantially from a first lateral edge of the structured insulative tape (see 22, FIG. 1C) to an opposite second lateral edge of the structured insulative tape (see 23, FIG. 1C), each first support 30*a* disposed between and maintaining a minimum separation between two adjacent conductors 10 in a conductor set 40, the two adjacent conductors 10 making contact with opposite sides of the first support 30*a*, and each shorter support 30*b*, disposed between the two or more conductors 10 and maintaining a minimum separation between the two or more conductors and a major surface (such as surface 21, FIG. 1B) of the structured insulative tape 20, the two or more conductors making contact the tops of the second supports 30*b*.

In an embodiment, two or more conductor sets 40 share a common shield 60. The shield 60 includes a first shield layer 60*a* and a second shield 60*b*, disposed on respective top and bottom sides of conductor sets 40. Each shield layer 60*a* and 60*b* includes an electrically conductive shielding layer 76 disposed on an electrically insulative substrate layer 78. Shield layers 60*a* and 60*b* are disposed on respective top and bottom sides of ribbon cable 100 such that they include cover portions 72 and pinched portions 74. Cover portions 72 of first shield layer 60*a* and second shield layer 60*b* are aligned or otherwise arranged with respect to each other such that, in combination, they surround a conductor set 40. Similarly, pinched portions 74 of first shield layer 60*a* and second shield layer 60*b* are aligned or otherwise arranged to form pinched portions 74 in shield 60, substantially surrounding and isolating each conductor set 40 in ribbon cable 100. In some embodiments, an adhesive may be used between the pinched portions 74 of first shield layer 60*a* and second shield layer 60*b*.

In some embodiments, shield 60 includes first and second shields 60*a* and 60*b* disposed on respective top and bottom sides of the ribbon cable 100 and includes cover portions 72 and pinched portions 74 arranged such that, in cross-section, the cover portions 72 of the first and second shields 60*a* and 60*b*, in combination, substantially surround the ribbon cable 100, and the pinched portions 74 of the first and second shields 60*a* and 60*b*, in combination, form pinched portions of the conductor set on at least one side of the ribbon cable 100. In some embodiments, the pinched portions 74 of the first and second shields 60*a* and 60*b*, in combination, form the pinched portions 74 of the conductor set 40 on each side of the ribbon cable 100. In some embodiments, the pinched portions 74 of the first and second shields 60*a* and 60*b*, in combination, form the pinched portions of the conductor set 40 only on one side of the ribbon cable 100.

Although the example of FIG. 5B shows two conductor sets 40 in ribbon cable 100, any appropriate number of conductor sets 40 may be included. Each conductor set 40 may have two conductors 10, as shown, or may have any appropriate number of conductors 10. For example, a conductor set 40 may have one, two, three, four, six, eight, ten, or twenty conductors 10. Each conductor set 40 may have the same number of conductors 10, or one or more of the conductor sets 40 may have a different number of conductors 10. One or more conductor sets 40 may include an additional conductive shield (not shown) disposed inside the cover portion 72 containing the conductor set 40 and surrounding the conductor set 40. This additional conductive shield may be longitudinally wrapped or helically wrapped around a conductor set 40, or may be applied by any appropriate shielding technique.

Figure 6A:
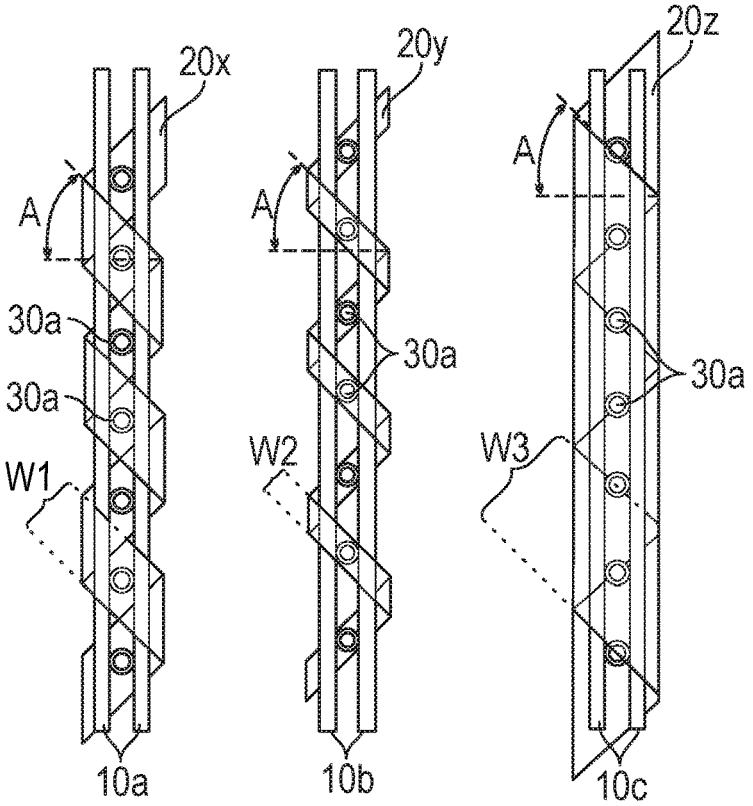
FIG. 6A is an illustrative view demonstrating various widths of structured insulative tape wrapped around an electrical cable in accordance with an embodiment of the invention.
Figure 6B:
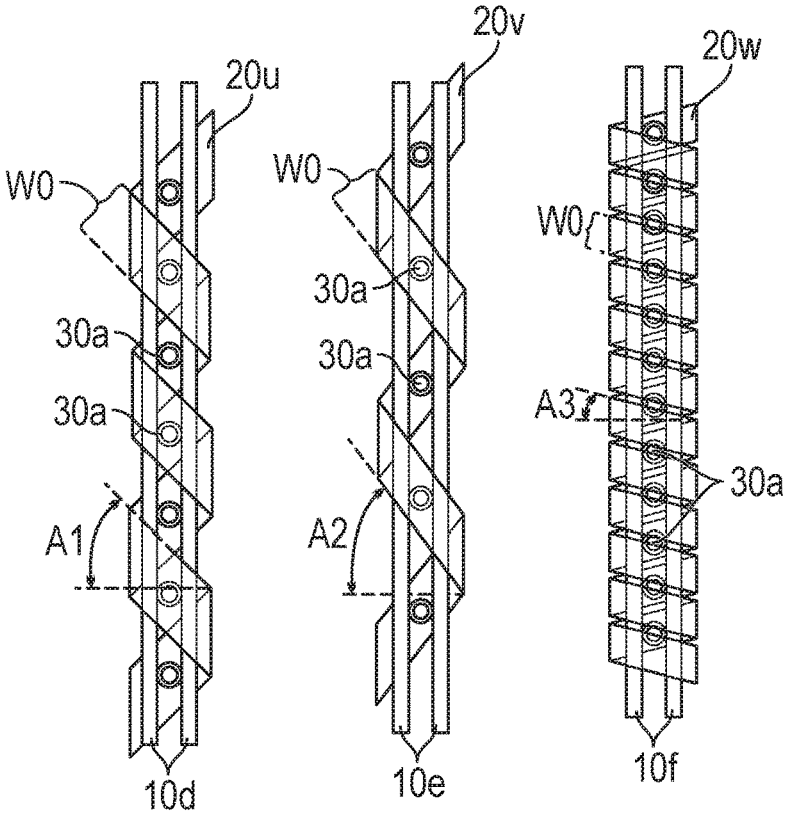
FIG. 6B is an illustrative view illustrating various wrap angles which can be used with a structured insulative tape wrapped around an electrical cable in accordance with an embodiment of the invention.

FIGS. 6A-6B provide illustrative views of how the width and wrap angle of a structured insulative tape can be varied to create electrical cables with different structural and electrical properties. FIG. 6A shows three different sets of conductors 10 (10*a*, 10*b*, 10*c*) wrapped by structured insulative tapes 20 (20*x*, 20*y*, 20*z*). Each structured insulative tape 20 has a set of taller first supports 30*a* that extends from a surface of the tape 20 up between two adjacent conductors 10, and each structured insulative tape 20 is helically wrapped about the corresponding conductors 10 using the same wrap angle A. However, each structured insulative tape 20 has a different width. Structured insulative tape 20*x* has a width of W1, structured insulative tape 20*y* has a width of W2, and structured insulative tape 20*z* has a width of W3. The various widths W1-W3 and wrap angle A are meant to be illustrative and are not limiting in any way. Any appropriate width and wrap angle may be used. As can be seen in these examples, using a narrower width (for example, width W2 in FIG. 6A) may create a cable that has increased air content (that is, more open space between successive wraps), and therefore a lower dielectric content as compared to a cable using a wider width (for example, width W3 in FIG. 6A). On the other hand, using a wider width tape (e.g., width W3), while reducing open space in the cable, may provide a cable that is more structurally sound (e.g., more resistant to crushing) than the use of a narrower width tape (e.g., width W2).

FIG. 6B shows three different sets of conductors 10 (10*d*, 10*e*, 10*f*) wrapped by structured insulative tapes 20 (20*u*, 20*v*, 20*w*). Each structured insulative tape 20 has a set of taller first supports 30*a* that extends from a surface of the tape 20 up between two adjacent conductors 10, and each structured insulative tape 20 is helically wrapped about the corresponding conductors 10. In the examples of FIG. 6B, the width W0 of each tape 20 is held constant, but the wrap angles are varied. Structured insulative tape 20*u* is wrapped with a wrap angle of A1, structured insulative tape 20*v* is wrapped with an angle of A2, and structured insulative tape 20*w* is wrapped with an angle of A3. As can be seen in these examples, a smaller wrap angle (e.g., angle A3) decreases the amount of open space in the resulting cable and increases the number of taller first supports 30*a* present between adjacent conductors 10, resulting in a more structurally sound cable when compared to a cable using a larger wrap angle (e.g., angle A2).

It should be noted that, for simplicity's sake, the examples provided do not show shorter second supports or conductive shielding. The intent of FIGS. 6A and 6B is to show the effect of varying the width and wrap angle of a structured insulative tape.

Figure 7:
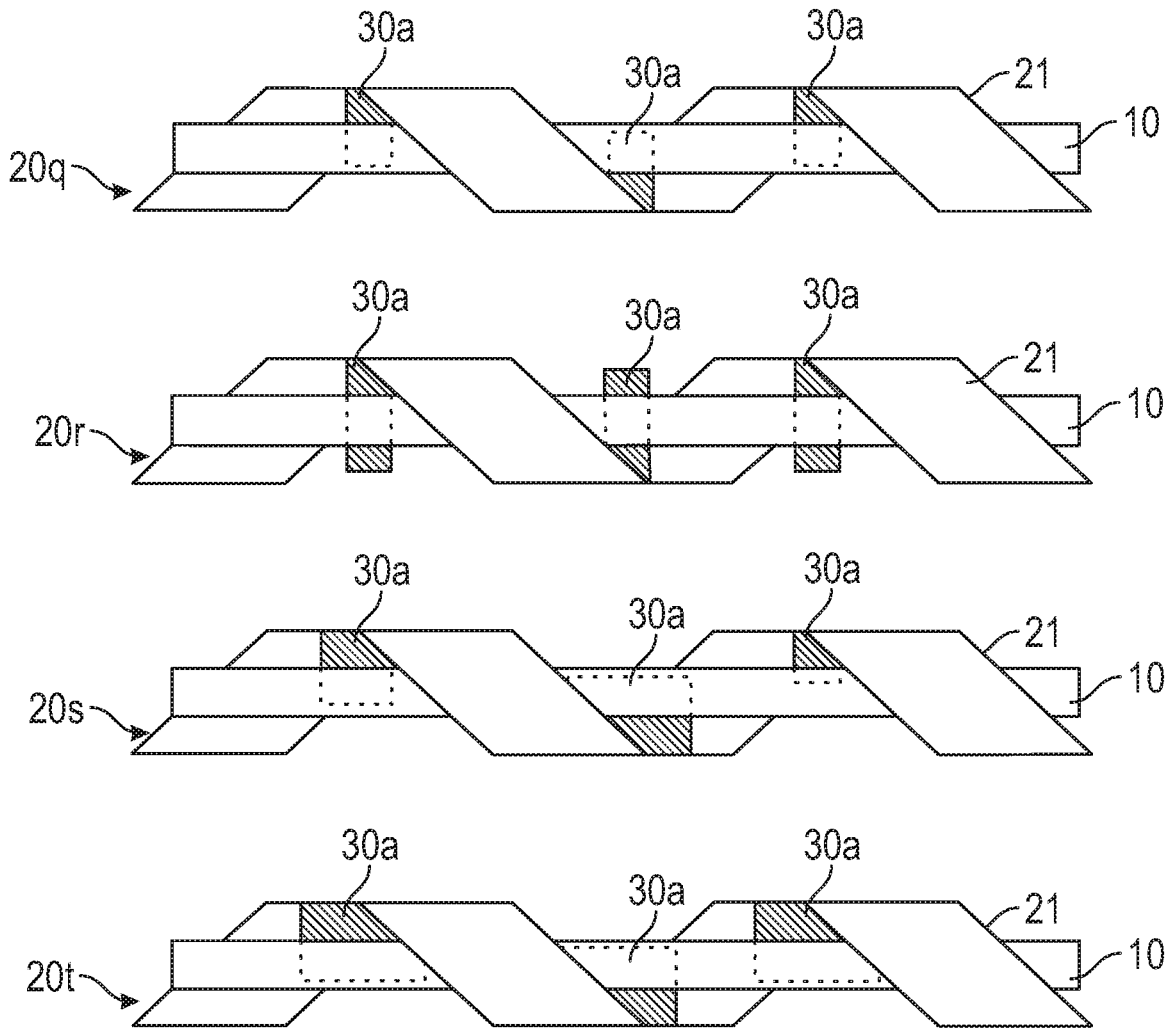
FIG. 7 is an illustrative view demonstrating various heights and widths of support structures which may be used with an electrical cable in accordance with an embodiment of the invention.

Finally, FIG. 7 is an illustrative side view demonstrating various heights and widths of support structures 30*a* which may be used with an electrical cable in accordance with an embodiment of the invention. The examples shown are intended to be illustrative only and are not limiting in any way. The examples show various structured insulative tapes 20 (20*q*, 20*r*, 20*s*, 20*t*) with taller first supports 30*a* of various dimensions. For the sake of simplicity, only conductors 10, structured insulative tape 20, and taller first supports 30*a* are shown, however, other components may be present. For example, shorter second supports 30*b* (FIG. 1B) may be present and provide spacing and support between conductors 10 and major surface 21 of structured insulative tape 20.

In example structured insulative tape 20*q*, supports 30*a* are substantially equal in size and placed at regular intervals along major surface 21. Supports 30*a* extend from surface 21 between conductors 10, but do not extend past conductors 10. In example structured insulative tape 20*r*, supports 30*a* are similarly spaced as those in tape 20*q*, but are longer, extending past conductors 10. Longer supports 30*a* such as these may be used to provide additional structure to the ribbon cable, providing support for an outer wrap such as a conductive shield or cable jacket. In example structured insulative tape 20*s*, supports 30*a* vary in both height and width throughout the length of the resulting ribbon cable. This may be done as required to balance trade-offs such as additional structural support (for example, additional crush resistance) and a lower dielectric constant. Finally, in example structured insulative tape 20*t*, supports 30*a* are broad, such that supports 30*a* span the width of major surface 21. As can be appreciated by one skilled in the art, any appropriate size, shape, and number or supports 30*a* may be used to achieve the desired properties in an electrical cable.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A ribbon cable, comprising:

a plurality of conductors extending along a length of the ribbon cable; and a structured insulative tape comprising a plurality of spaced apart supports forming alternating first and second groups of supports disposed on a major surface thereof, each first group of supports comprising at least one taller first support, each second group of supports comprising at least one shorter second support, the structured insulative tape helically wrapped around the plurality of conductors along the length of the ribbon cable such that each first group of supports is disposed between and maintains a minimum separation between two adjacent conductors, each of the two adjacent conductors making contact with a side of the at least one taller first support, and each second group of supports is disposed around one or more conductors, each of the one or more conductors making contact with a top of the at least one shorter second support.

2. The ribbon cable of claim 1, wherein each pair of adjacent conductors comprises a plurality of groups of first supports disposed therebetween spaced apart along the length of the ribbon cable.

3. The ribbon cable of claim 1, wherein each first group of supports comprises a single taller first support, and each second group of supports comprises at least two spaced apart shorter second supports.

4. The ribbon cable of claim 1, wherein at least one first group of supports comprises a single taller first support and at least one other first group of supports comprises two taller first supports.

5. The ribbon cable of claim 1, wherein at least one second group of supports comprises a single shorter second support and at least one other second group of supports comprises at least two shorter second supports.

6. The ribbon cable of claim 1, wherein the structured insulative tape has a projected width along the length of the ribbon cable and is wrapped around the plurality of conductors at a pitch greater than the projected width, a difference between the pitch and the projected width defining a helical gap between adjacent wraps of the structured insulative tape, the helical gap greater than the projected width by at least a factor of 2.

7. The ribbon cable of claim 1, wherein the first and second supports are porous.

8. The ribbon cable of claim 7, wherein the porous first and second supports have an air content of greater than about 40% by volume.

9. The ribbon cable of claim 1, wherein the first and second supports have dielectric constants less than about 1.7.

10. A conductor set, comprising:

the ribbon cable of claim 1; and an electrically conductive shield substantially surrounding the ribbon cable.

11. The conductor set of claim 10, wherein the electrically conductive shield is wrapped around the ribbon cable.

12. The conductor set of claim 10, wherein the electrically conductive shield comprises first and second shields disposed on respective top and bottom sides of the ribbon cable and including cover portions and pinched portions arranged such that, in cross-section, the cover portions of the first and second shields, in combination, substantially surround the ribbon cable, and the pinched portions of the first and second shields, in combination, form pinched portions of the conductor set on at least one side of the ribbon cable.

13. The conductor set of claim 12, wherein each of the first and second shields comprises an electrically conductive shielding layer disposed on an electrically insulative substrate layer.

14. The conductor set of claim 12, wherein the pinched portions of the first and second shields, in combination, form the pinched portions of the conductor set on each side of the ribbon cable.

15. The conductor set of claim 12, wherein the pinched portions of the first and second shields, in combination, form the pinched portions of the conductor set only on one side of the ribbon cable.

16. The conductor set of claim 10 further comprising an adhesive adhering the first and second shields to each other in each pinched portion of the conductor set.

17. The ribbon cable of claim 1, wherein the plurality of conductors comprises only two conductors.

18. An electrical cable, comprising:

a plurality of spaced apart substantially parallel conductor sets extending along a length of the electrical cable and arranged along a width of the electrical cable, each conductor set comprising two substantially parallel conductors extending along the length of the electrical cable and arranged along the width of the electrical cable; and a structured insulative tape helically wrapped around the two substantially parallel conductors of each conductor set along the length of the electrical cable, the structured insulative tape comprising a plurality of spaced apart first and second supports disposed on an inner major surface thereof facing the two substantially parallel conductors, each first support taller than each second support, each first and second supports extending substantially from a first lateral edge of the structured insulative tape to an opposite second lateral edge of the structured insulative tape, the first supports disposed between and maintaining a minimum separation between the two substantially parallel conductors, the two substantially parallel conductors making contact with opposite sides of the first supports, the second supports disposed around the two substantially parallel conductors and maintaining a minimum separation between the two substantially parallel conductors and the inner major surface of the structured insulative tape, the two substantially parallel conductors making contact with tops of the second supports.

19. The electrical cable of claim 18, wherein at least one conductor in at least one conductor set is an uninsulated conductor.

20. The electrical cable of claim 18, wherein at least one conductor in at least one conductor set is an insulated conductor.

* * * * *